United States Patent [19]

Hirose et al.

[11] 4,417,800

[45] Nov. 29, 1983

[54] IMAGE TRANSFER MATERIAL SEPARATION APPARATUS FOR ELECTROPHOTOGRAPHIC COPYING MACHINE

[75] Inventors: Akira Hirose, Tokyo; Kenzo Ariyama, Yokohama, both of Japan

[73] Assignee: Ricoh Company, Ltd., Japan

[21] Appl. No.: 288,784

[22] Filed: Jul. 31, 1981

[30] Foreign Application Priority Data

Aug. 1, 1980 [JP] Japan ..... 55-105972

[51] Int. Cl.[3] ..... G03G 15/14; G03G 15/22

[52] U.S. Cl. ..... 355/3 TR; 271/312; 271/313; 355/3 SH

[58] Field of Search ..... 355/3 R, 3 TR, 3 SH, 355/14 TR, 14 SH; 271/307, 308, 311, 312, 313, DIG. 2

[56] References Cited

U.S. PATENT DOCUMENTS

| | | | |
|---|---|---|---|
| 3,450,402 | 6/1969 | Weiler | 271/308 |
| 3,687,539 | 8/1972 | Furuichi | 355/3 R X |
| 3,820,776 | 6/1974 | Fujimoto et al. | 271/308 |
| 3,912,256 | 10/1975 | Nagahara | 271/311 |
| 3,926,429 | 12/1975 | Satomi et al. | 271/308 |
| 4,060,230 | 11/1977 | Church et al. | 271/312 |

FOREIGN PATENT DOCUMENTS

| | | | |
|---|---|---|---|
| 3032505 | 3/1981 | Fed. Rep. of Germany | 271/312 |

*Primary Examiner*—Fred L. Braun

*Attorney, Agent, or Firm*—Guy W. Shoup; Gerard F. Dunne

[57] ABSTRACT

An image transfer material separation apparatus for an electrophotographic copying machine, in which a leading edge of an image transfer material is curled in such a direction as to be separated from the surface of a photoconductor on which a latent electrostatic image or a visible image is formed, before the image transfer material is brought into close contact with the latent-electrostatic-image- or visible-image-bearing photoconductor, and after image transfer, an image transfer material separation member, disposed away from the surface of the photoconductor, is pushed by the curled leading edge portion of the image transfer material, whereby the image transfer material is guided in the direction different from the movement direction of the photoconductor and is separated from the surface of the photoconductor and is then transported, for instance, towards an image fixing station.

28 Claims, 42 Drawing Figures

IMAGE TRANSFER MATERIAL SEPARATION APPARATUS FOR ELECTROPHOTOGRAPHIC COPYING MACHINE

BACKGROUND OF THE INVENTION

The present invention relates to an apparatus for separating image transfer material in an electrophotographic copying machine.

Various copying methods have been adopted in copying machines, in particular, in electrophotographic copying machines. The conventional copying methods of electrophotographic copying machines can be roughly classified into a visible image transfer type and a latent electrostatic image transfer type.

In the visible image transfer type copying method, a latent electrostatic image is formed on the surface of a photoconductor and the latent electrostatic image formed on the photoconductor is developed to a visible image and the visible image is then transferred to an image transfer material.

In the latent image transfer type copying method, the latent electrostatic image formed on the photoconductor is transferred to an image transfer material and the latent electrostatic image transferred to the image transfer material is then developed to a visible image.

In both image transfer copying methods, the step for separating the image transfer material, which is moved in uniform contact with the surface of the photoconductor, from the surface of the photoconductor after image transfer is very important and many varities of apparatus for performing the separation of the image transfer material from the photoconductor have been proposed.

An example of an image transfer material separation apparatus in general use employs a pick-off pawl with a top pawl portion thereof brought into contact with the surface of the photoconductor for picking the image transfer material off the surface of the photoconductor. In an image transfer material separation apparatus of this type, it is required that the top pawl portion be extremely sharp. Otherwise, proper and smooth separation of the image transfer material from the surface of the photoconductor cannot always be done. However, the sharper the top pawl portion, the greater the separation performance, but the greater the risk of the surface of the photoconductor being scratched by the top pawl portion or of the top pawl portion being abraded, resulting in significant decrease in separation performance of the pick-off pawl.

Another conventional example of the image transfer material separation apparatus has a pick-off pawl which is in a groove formed in the peripheral surface of a photoconductor drum in the axial direction thereof. In this image transfer material separation apparatus, it is required that the phoconductor drum be extremely accurately positioned at its home position. In order to attain such accurate positioning of the photoconductor drum, a complicated mechanism and control thereof are required.

In a further conventional image transfer material separation apparatus, for instance, one disclosed in U.S. patent application Ser. No. 219,258 filed Dec. 12, 1980 which is a continuation-in-part of application Ser. No. 213,650 filed Dec. 5, 1980 and now abandoned, a leading edge portion of the image transfer material is bent upwardly before the material reaches the image transfer station so as to be separated from the surface of the photoconductor during image transfer. The separated leading edge portion of the image transfer material is maintained away from the surface of the photoconductor and a pick-off pawl is disposed so as to be always in contact with the surface of the photoconductor, so that as the image transfer material is moved together with the photoconductor, the separated portion of the image transfer material is scooped up by the pick-off pawl and the image transfer material is then completely separated from the surface of the photoconductor. After separation of the image transfer material from the photoconductor, the image transfer material is transported by an image transfer material transportation device.

In this image transfer material separation apparatus, a charging apparatus comprising an image transfer charger and a separation charger is employed. The separation charger serves to assist in the separation of the image transfer material from the surface of the photoconductor. However, when the voltage applied to the separation charger is low, the electrostatic attraction of the image transfer material to the surface of the photoconductor cannot be decreased enough so that the image area of the image transfer material may be scratched by an edge portion of the pick-off pawl and the image quality may be considerably degraded. In contrast to this, when the voltage applied to the separation charger is high, toner images formed on the image transfer material may separate from the surface of the image transfer material and deposited on the surface of the photoconductor.

Furthermore, when voltage applied to the separation charger is varied, the position of the leading edge of the image transfer material becomes unsteady after the image transfer material is separated from the surface of the photoconductor. As a result, the direction of transportation of the image transfer material varies and the image transfer material may not be properly received by the image transfer material transportation device.

When the leading edge portion of the image transfer material is bent so as to be separated from the surface of the photoconductor, if the leading edge of the image transfer material is contained in the leading edge portion bent, wrinkling or skewing of the image transfer material may take place when the image transfer material is fed to an image fixing apparatus, in particular, to the roller-type image fixing apparatus typically used.

SUMMARY OF THE INVENTION

It is therefore a primary object of the present invention to provide an image transfer material separation apparatus for an electrophotographic copying machine, which is capable of separating the image transfer material from a photoconductor without scratching either the surface of the photoconductor or the images transferred to the image transfer material, and from which shortcomings of conventional image transfer material separation apparatus are eliminated.

This object is attained by an image transfer material separation apparatus for separating an image transfer material from the surface of a photoconductor after a latent electrostatic image or a visible image formed on the surface of the photoconductor has been transferred to the image transfer material by bringing the image transfer material into close contact with the latent-electrostatic-image-or visible-image-bearing photoconductor, which image transfer material separation apparatus comprises a leading-edge-lifting-and-deforming apparatus for lifting the leading edge of the image transfer material away from the surface of the photoconductor and deforming the leading edge portion in the lifting direction prior to image transfer, and an image transfer material separation member, with the base portion thereof swingably supported and the free end portion thereof disposed in close proximity to the surface of the photoconductor. The image transfer material separating member preferably includes a catching portion for catching the deformed portion of the image transfer material to rotate the free end portion of the image transfer material separation member in such a direction as to move away from the surface of the photoconductor by the advancing force of the image transfer material, so that the image transfer material is gradually separated from the surface of the photoconductor and the leading edge of the image transfer material is guided in such a direction as to be separated from the surface of the photoconductor. An image transfer material catching and transportation apparatus is disposed near the free end of the image transfer material separation member and catches and transports the image transfer material whose transportation direction has been changed by the image transfer material separation member.

In this image transfer material separation apparatus, a deformed portion is formed in the leading edge portion of the image transfer material and the deformed portion is caught by the image transfer material separation member. The image transfer material separation member is caused to rotate by the advancing force of the image transfer material, whereby the travelling direction of the image transfer material is properly changed. The image transfer material whose traveling direction has been properly changed is then securely caught and transported by the image transfer material catching and transportation apparatus. Therefore, separation of the image transfer material from the surface of the photoconductor can be securely performed and unlike the conventional image transfer material separation apparatus, images formed on the image transfer material are not scratched by the pick-off pawl and the separation performance is not affected by the voltage applied to the separation charger and the image transfer charger. Furthermore, it is unnecessary that the image transfer material separation member be in contact with the surface of the photoconductor and therefore there is minimal risk that the surface of the photoconductor be scratched by the image transfer material separation member. As a matter of course, the image transfer material separation member can be brought into contact with the surface of the photoconductor to the extent that the image transfer material separation member does not scratch the surface of the photoconductor.

Furthermore, in this image transfer material separation apparatus, only one image transfer material separation member is needed when separation of the image transfer material is performed by bending or curving a corner of the leading edge portion of the image transfer material. Therefore, in comparison with an image transfer material separation apparatus comprising a plurality of pick-off pawls which are always in contact with the surface of the photoconductor, the image transfer material separation apparatus according to the present invention is simpler in mechanism and has less risk that the surface of the photoconductor is subjected to scratching.

Another object of the present invention is to provide an image transfer material separation apparatus of the type described above, which is particularly capable of securely separating the image transfer material from the photoconductor even if two sheets of the image transfer material are transported to the image transfer material separation apparatus.

Normally, the image transfer materials are individually separated by a sheet feeding apparatus when they are transported onto the surface of the photoconductor for image transfer. However, for some reason, for instance, because of two sheets of the image transfer material clinging together, it may occur that two sheets are transported towards the photoconductor at the same time. In this case, if the leading edges of the two sheets are lined up, the two sheets of the image transfer material will be separated together from the surface of the photoconductor by the previously mentioned image transfer material separation member. However, in most cases, two superimposed sheets of the image transfer material are caused to shift from each other before the two sheets come into contact with the image transfer material separation member because a pair of sheet feeding rollers, sheet transporting means including registration rollers for synchronizing the movement of the photoconductor with the transportation of the image transfer material act upon the two superimposed sheets of the image transfer material by the time they come into contact with the image transfer material separation member. Of the two sheets of the image transfer material, one which is not in direct contact with the surface of the photoconductor is apt to move ahead of the sheet which is in direct contact with the photoconductor. When this takes place, the previously mentioned image transfer material separation member is pushed by the preceding sheet, so that the transportation direction of that sheet is changed and is then transported towards the previously mentioned image transfer material catching and transportation device, while the succeeding sheet which is under the preceding sheet remains in close contact with the surface of the photoconductor and is moved together with the photoconductor, without being discharged from the copying machine.

In order to eliminate such inconvenience, in the present invention, an auxiliary separation member may be disposed in a position downstream of the above-mentioned image transfer materials separation member, whereby even if two sheets are fed at the same time, they can be securely separated from the photoconductor. The auxiliary separation member is made of a soft material and does not cause any scratching problem even if the top portion of the auxiliary separation member is positioned in contact with the surface of the photoconductor.

Furthermore, in the present invention, bending of the leading edge portion of the image transfer material is performed in such a manner that the bending does not extend to the very leading edge of the image transfer material, whereby skewing or wrinkling of the image transfer material, which may be otherwise caused in the course of the image fixing process after the image transfer process, is prevented.

The other object and features of the present invention can be readily understood from the following detailed description of the preferred embodiments according to the invention in conjunction with the brief description of the drawings.

DETAILED DESCRIPTION OF THE PREFERRED EMBODIMENTS

Figure 1:
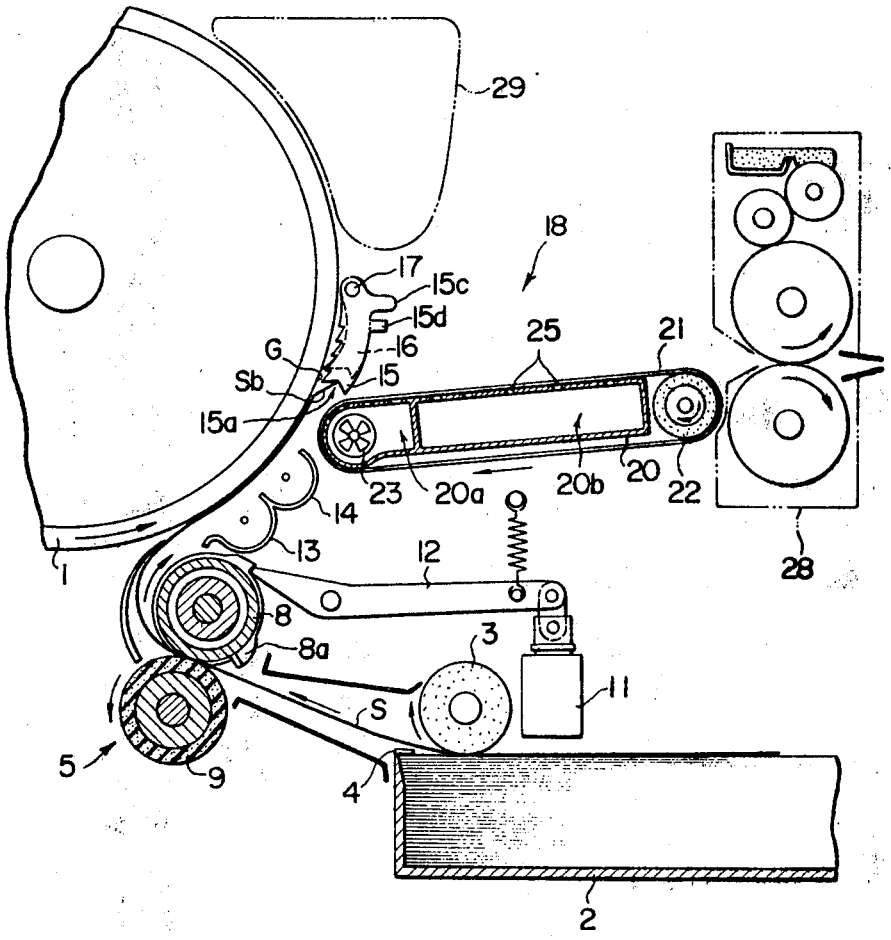
FIG. 1 is a schematic sectional view of an electrophotographic copying machine provided with an embodiment of an image transfer material separation apparatus according to the present invention.

Referring to FIG. 1, there is schematically shown an example of an electrophotographic copying machine provided with an embodiment of an image transfer material separation apparatus according to the present invention.

In the figure, a drum-shaped photoconductor (hereinafter referred to as the photoconductor drum) 1 is rotated in the direction of the arrow. On the peripheral outer surface of the photoconductor drum 1, there is formed a latent electrostatic image by projecting an optical image to the surface of the photoconductor drum 1. The latent electrostatic image is developed to a visible image by a development apparatus (not shown).

This electrophotographic copying machine is of a visible image transfer type and plain paper is used as image transfer material. Therefore, the plain paper is referred to as the image transfer sheet.

Figure 2:
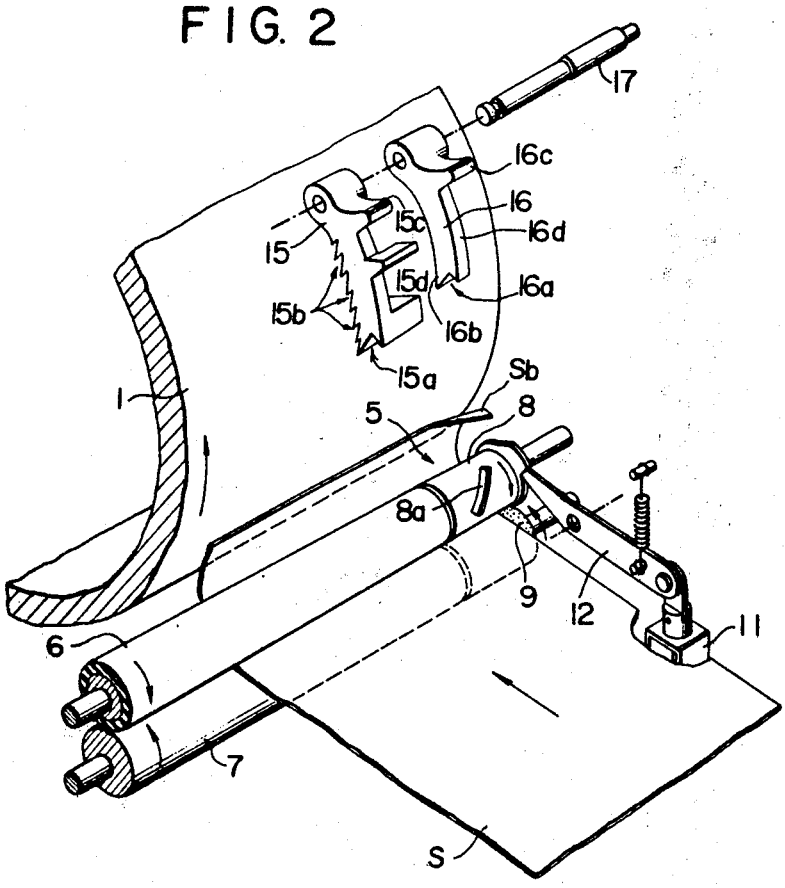
FIG. 2 is a perspective view of the configuration of a photoconductor, a leading-edge-lifting-and-deforming apparatus, an image transfer material separation member and an auxiliary separation member.
Figure 7:
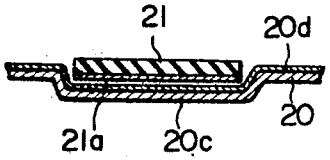
FIG. 7 is an enlarged sectional view of the attachment of the sheet tranportation belts of the air-suction-type sheet transportation apparatus to a negative-pressure tank.

The image transfer sheets are stacked in a sheet feeding cassette 2 and are transported individually by a sheet feed roller 3 and a corner separator 4, starting with the top sheet. As shown in FIG. 2, in the image transfer sheet feeding direction, there are disposed registration rollers 6 and 7 and a leading-edge-lifting-and-deformation-device 5 (hereinafter referred to as the deformation device 5) for lifting the leading edge portion of the image transfer sheet S in the direction away from the surface of the photoconductor and deforming the leading edge portion of the image transfer sheet S. The deformation device 5 comprises a curved-blade roller 8 and an elastic roller 9 which are respectively attached to one end of the registration roller 6 and to one end of the registration roller 7.

On the peripheral surface of the curved-blade roller 8, there is formed a curved blade 8*a*, while the elastic roller 9 is made of an elastic material, such as soft rubber or sponge rubber. The image transfer sheet S fed from the sheet feeding cassette 2 comes to the contact area between the registration rollers 6 and 7, where the leading edge portion of the image transfer sheet S is temporarily stopped and the image transfer sheet S is stopped under a slightly slacked condition. Under this condition, one leading corner portion of the image transfer sheet S is positioned in the contact area between the curved-blade roller 8 and the elastic roller 9.

After the leading edge portion of the image transfer sheet S stops at the contact area between the registration rollers 6 and 7, a registration signal is generated. In accordance with this registration signal, the registration rollers 6 and 7 begin to rotate and at the same time, a solenoid 11 is energized. Within the curved-blade roller 8, there is disposed a one-rotation clutch which terminates clutching performance after every one rotation. When the solenoid 11 is energized, a clutch lever 12 releases the curved-blade roller 8, so that the curved-blade roller 8 makes one revolution by the function of the one-rotation clutch.

During one revolution of the curved-blade roller 8, the curved blade 8*a* is brought into pressure contact with the elastic roller 9 with the image transfer sheet S placed therebetween to the extent that the surface of the elastic roller 9 is elastically deformed partially. As a result, a leading corner end portion of the image transfer sheet S is bent in such a manner as to separate from the surface of the photoconductor drum 1, forming a deformed portion Sb.

The deformation device 5 of this embodiment deforms one leading edge corner in such a manner as to be lifted from the surface of the photoconductor drum 1.

The image transfer sheet S with the deformed portion Sb is then transported towards the photoconductor drum 1 by the registration rollers 6 and 7 and brought into contact with the photoconductor drum 1. The image transfer sheet S is moved together with the photoconductor drum 1 while in close contact therewith. During this movement, a visible image formed on the surface of the photoconductor drum 1 is transferred to the image transfer sheet S by the corona charging action of an image transfer charger 13.

The corona charges applied to the image transfer sheet S are neutralized by a separation charger 14 which helps sheet separation. The image transfer sheet S is then transported towards an image transfer material separation member 15 (hereinafter referred to as the separation member 15).

The separation member 15 and a auxiliary sheet separation member 16 located adjacent the separation member 15 are rotatably supported by a shaft 17 through their respective base portions. In the free end portion of the separation member 15, there is formed a V-shaped sheet catching portion 15*a*, and in a portion of the separation member 15, facing the surface of the photoconductor drum 1, there is formed a saw-tooth-shaped sheet catching portion 15*b*. In the free end portion of the auxiliary separation member 16, there is formed a V-shaped sheet catching portion 16*a*. A pawl portion 16*b* formed in the V-shaped sheet catching portion 16*a* is brought into contact with the surface of the photoconductor drum 1 due to the moment produced by a weight portion 16*c* formed in the auxiliary sheet separation member 16.

By the moment produced by a weight portion 15*c* formed in the separation member 15, the separation member 15 is urged in such a fashion that the free end of the separation member 15 is brought near the surface of the photoconductor drum 1. The rotation of the separation member 15 which is urged as mentioned above is prohibited by a projected portion 15*d* which comes into contact with a back side portion 16*d* of the auxiliary sheet separation member 16. Under such a condition, there is formed a gap G between the separation member 15 and the surface of the photoconductor drum 1.

Figure 5:
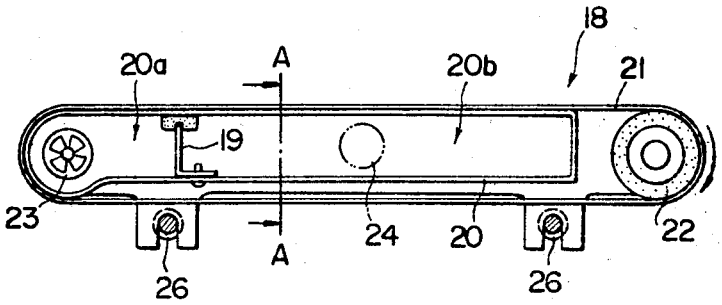
FIG. 5 is a side view of the air-suction-type sheet transportation apparatus in FIG. 4.

Referring back to FIG. 1, a front portion of an air-suction type transportation apparatus 18, which serves as an image transfer material catching and transportation apparatus, is located near the free end portion of the separation member 15 and the surface of the photoconductor drum 1. As shown in FIG. 5, the air-suction-type sheet transportation apparatus 18 comprises a negative-pressure tank 20 and sheet transportation belts 21. The negative-pressure tank 20 is divided into a chamber 20*a* and a chamber 20*b* by a partition plate 19.

Figure 6:
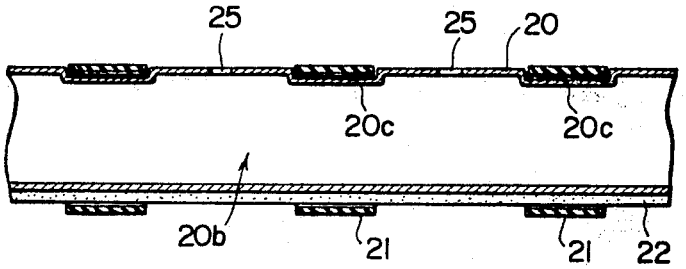
FIG. 6 is a partial sectional view taken on line A—A in FIG. 5.
Figure 4:
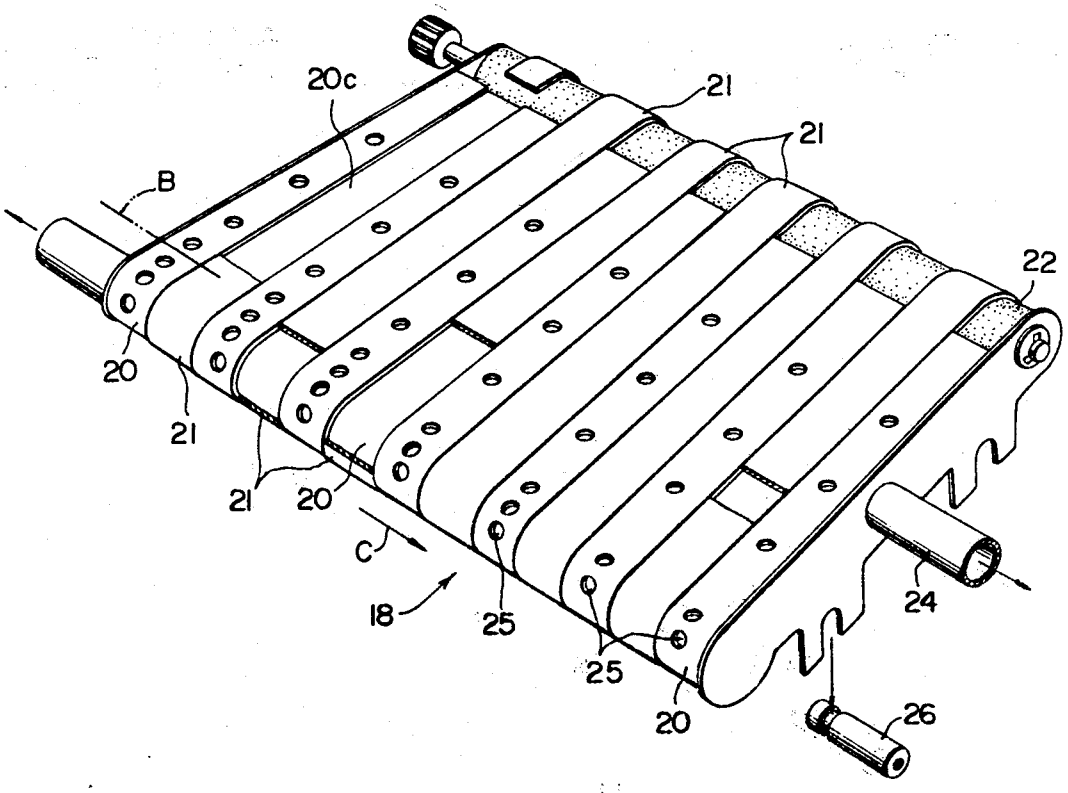
FIG. 4 is a perspective view of an air-suction-type sheet transportation apparatus.

The sheet transportation belts 21 consist of a number of belts arranged side by side as shown in FIG. 4 and are trained over a belt roller 22 and groove portions 20*c* of the negative-pressure tank 20 as shown in FIG. 6. The outer surface of the sheet transportation belts 21 and the outer surface of the negative-pressure tank 20 are at the same level or the former is slightly above the latter. The surface of the negative-pressure tank 20 is coated with a low-friction material 20*d*, for instance, Teflon (trade name), and to the back side of the sheet transportation belts 21 is applied a low-friction material 21*a* which is the same as or similar to the low-friction material 20*d*, whereby the sliding friction between the sheet transporation belts 21 and the surface of the negative-pressure tank 20 is significantly reduced when the sheet transportation belts 21 are driven by the rotation of the belt roller 22.

A fan 23 is disposed within the chamber 20*a* to make the pressure in the chamber 20*a* negative. The pressure in the chamber 20*b* which is located adjacent to the chamber 20*a* is also made negative by connecting the chamber 20*a* to the chamber 20*b* through a pipe 24 as shown in FIG. 4 or by connecting the pipe 24 to another suction pipe (not shown). Air-suction apertures 25 are formed in the portions of the negative-pressure tank 20 between each sheet transportation belt 21, so that air is sucked into the negative-pressure tank 20 through the air-suction apertures 25. The thus constructed air-suction-type sheet transportation apparatus 18 is supported by a support member 26. In FIG. 4, the imaginary line B indicates the position of the partition plate 19 between the two chambers 20*a* and 20*b*.

Referring to FIG. 8(*a*), the image transfer sheet S is moved together with the rotating photoconductor drum 1 after image transfer, so that the leading edge of the image transfer sheet S is advanced towards the separation member 15. Finally, the deformed portion Sb (refer to FIG. 2) formed in one corner portion of the image transfer sheet S is caught by the catching portion 15*a* of the separation member 15.

The deformed portion Sb of the image transfer sheet S comes into contact with the catching portion 15*a*. The separation member 15 is then rotated counterclockwise about the shaft 17 by the advancing force of the image transfer sheet S as shown in FIG. 8(*b*). As the separation member 15 is rotated, the image transfer sheet S is gradually separated from the surface of the photoconductor drum 1, so that the transportation direction of the leading edge portion of the image transfer sheet S is changed to such a direction that the image transfer sheet S is separated from the surface of the photoconductor drum 1. Thus, the sheet separation member 15 serves to catch the image transfer sheet S and to guide the same in the separation direction mentioned above.

As mentioned previously, air flows into the negative-pressure tank 20 through the air-suction apertures 25. Therefore, the image transfer sheet S whose transportation direction has been changed as mentioned above is attracted to the air-suction-type sheet transportation apparatus 18 as shown in FIG. 8(*d*). The image transfer sheet S is then transported to the left in the figure by the sheet transportation belts 21 which are rotated in the direction of the arrow.

Referring back to FIG. 1, the image transfer sheet S attracted to and carried by the air-suction-type sheet transportation apparatus 18 is fed to an image fixing apparatus 28 and is then discharged as a copy onto a sheet discharge tray (not shown) located outside the copying machine.

Toner remaining on the surface of the photoconductor drum 1 is removed therefrom by a cleaning apparatus 29.

Figure 3:
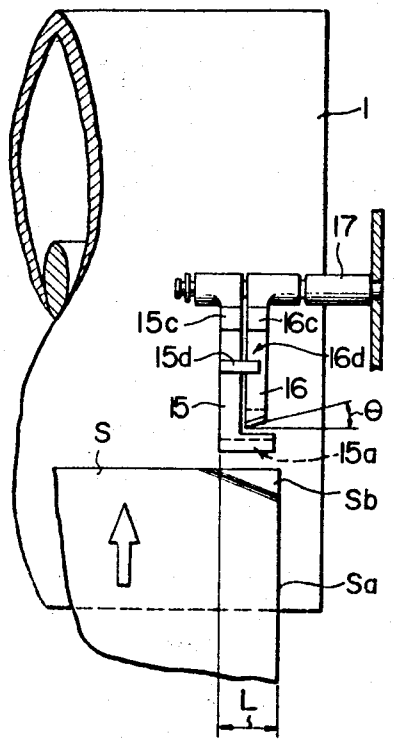
FIG. 3 is a front view of an image transfer material catching device, particularly showing the configuration of an image transfer material, the image transfer material separation member and the auxiliary separation member.
Figure 8A:
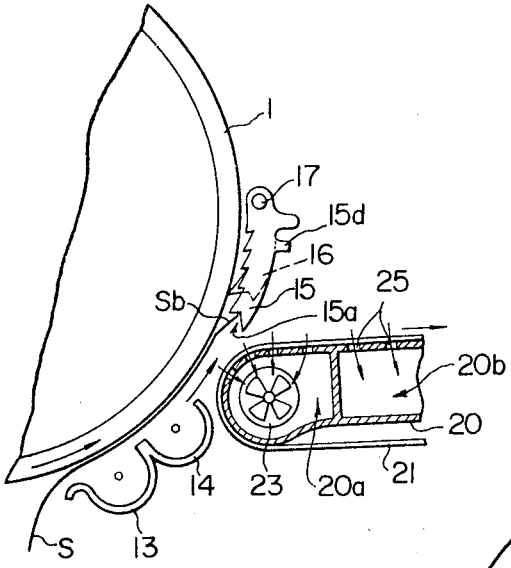
FIGS. 8(*a*) to 8(*d*) show the operation of the image transfer material separation apparatus according to the present invention after image transfer.
Figure 8B:
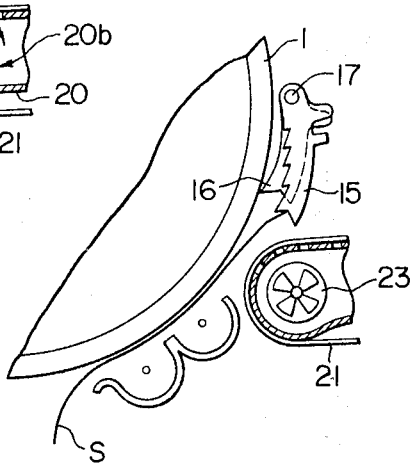
Figure 8C:
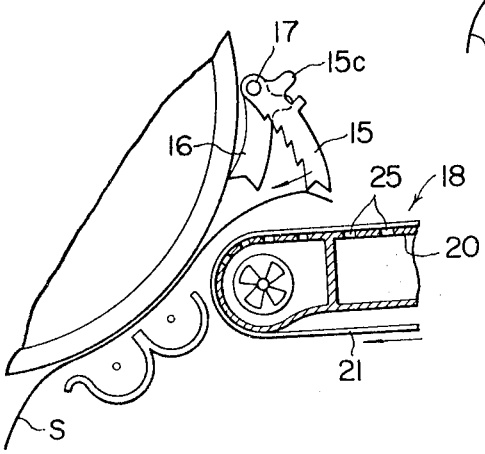
Figure 8D:
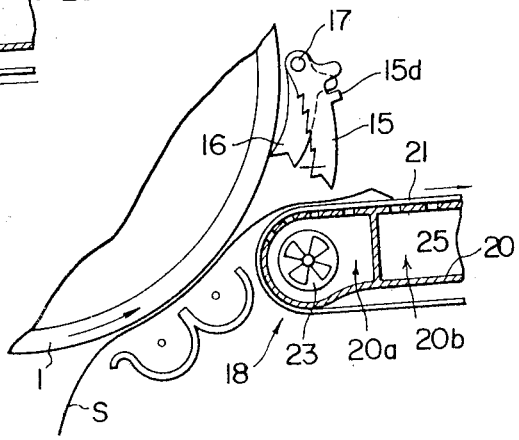

Referring to FIG. 3, it must be noted here that there must be a predetermined distance L between the side edge Sa of the image transfer sheet S and the side edge of the separation member 15. Otherwise, the deformed portion Sb of the image transfer sheet S may be detached from the catching portion 15*a* before the image transfer sheet S has been completely turned.

Referring to FIG. 8(*c*), when the image transfer sheet S is attracted to the air-suction-type sheet transportation apparatus 18 and is moved away from the separation member 15, the separation member 15 is rotated clockwise around the shaft 17 due to the weight of the weight portion 15*c* and then comes to a position as shown in FIG. 8(*d*), and then back to the position shown in FIG. 8(*a*). The projected portion 15*d* comes into contact with the back side portion 16*d* of the auxiliary separation member 16 as shown in FIG. 8(*a*), so that the separation member 15 is stopped at that position.

As mentioned previously and as shown in FIG. 5, the closed negative-pressure tank 20 of the air-suction-type sheet transportation apparatus 18 is divided into two chambers 20*a* and 20*b*, so that stronger sucking force may be applied to the image transfer sheet S on the sheet-transportation-direction-changing side of the apparatus 18 than on the image fixing side of the apparatus 18. More specifically, referring to FIG. 4, more air-suction apertures 25 are formed on the sheet-transportation-changing side of the air-suction-type sheet transportation apparatus 18, that is, on the side nearer to the photoconductor drum 1 with respect to the boundary between the two chambers 20*a* and 20*b* which is shown by the imaginary line B, than on the image fixing side which is opposite to the sheet-transportation-direction-changing side with respect to the imaginary line B.

In the above-described negative-pressure tank 20, the two chambers 20*a* and 20*b* are designed in such a manner that the negative pressure in the two chambers is the same.

However, the present invention is not limited to such construction, but the negative-pressure tank 20 can be constructed as follows:

An independent air-suction apparatus is disposed in each of the chamber 20*a* on the sheet-transportation-direction-changing side and the chamber 20*b* on the image fixing side. The negative pressure in the chamber 20*a* is set greater in terms of absolute value than the negative pressure in the chamber 20*b*, so that when the leading edge of the image transfer sheet S comes near the sheet separation section, the air-suction apparatus in the chamber 20*a* is energized in order to apply great sucking force to the image transfer sheet S and when the image transfer sheet S comes near the image fixing section, the air-suction apparatus in the chamber 20*a* is deenergized and only the air-suction apparatus in the chamber 20*b* is energized so that comparatively small sucking force is applied to the image transfer sheet S.

In both embodiments, when the transportation direction of the image transfer sheet S is changed, comparatively great sucking force is applied to the image transfer sheet S, while when the image transfer sheet S comes near the image fixing section, the sucking force applied to the image transfer sheet S is descreased, so that comparatively great freedom is given to the image transfer sheet S during the transportation thereof and therefore this construction can prevent formation of wrinkles in the image transfer sheet S and can feed the image transfer sheet S to the image fixing rollers of an image fixing apparatus 28.

When the leading edge portion of the image transfer sheet S comes to the chamber 20*b*, air-sucking of the chamber 20*a* can be stopped or the sucking force thereof can be reduced.

As shown in FIG. 4, the air-suction apertures 25 are decreased in number in the direction of arrow C, whereby a suction force gradient is formed in that direction. By the suction force gradient, greater sheet separation force is applied to the image transfer sheet S on the side of the sheet separation member 15 than on the opposite side of the sheet separation member 15, so that separation of the image transfer sheet S from the surface of the photoconductor drum 1 can be done securely and speedily. Once the sheet separation begins, entire separation of the image transfer sheet S from the photoconductor drum 1 can be done readily.

Since the sheet transportation belts 21 and the negative-pressure tank 20 are in contact with each other through the previously mentioned low-friction material, comparatively small driving force of the belt roller 22 can drive the sheet transportation belts 21 sufficiently for the transportation of the image transfer sheet S.

Furthermore, in the air-suction-type sheet transportation apparatus 18, it is unnecessary to dispose counterpart rollers of the sheet transportation belt 21 in the chamber 20*a* and therefore, comparatively great space for producing negative pressure can be obtained.

Furthermore, in this embodiment, it is preferable that the air-suction-type sheet transportation apparatus 18 be positioned as close as possible to the surface of the photoconductor drum 1 and to the separation member 15 for efficient sheet separation in such a manner that the air-suction apertures 25 are positioned close to the image transfer sheet S prior to the separation thereof from the surface of the photoconductor drum 1.

Referring now back to FIG. 1, when the image transfer sheet S is fed from the sheet feeding cassette 2, double sheet feeding may take place. For example, when two image transfer sheets S are fed from the cassette 2, the top sheet is apt to go slightly ahead of the next sheet.

Figure 9A:
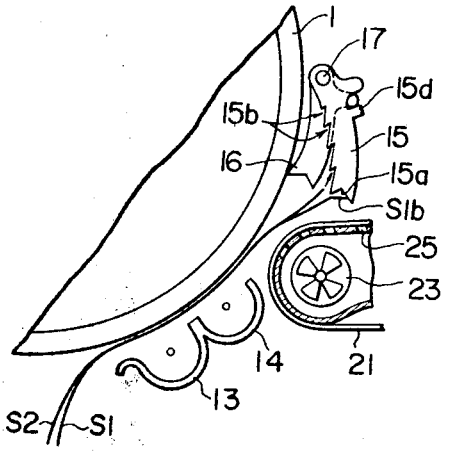
FIGS. 9(*a*) to 9(*c*) show the change of the transportation direction of each of superimposed sheets of image transfer material which are transported together after image transfer.
Figure 9B:
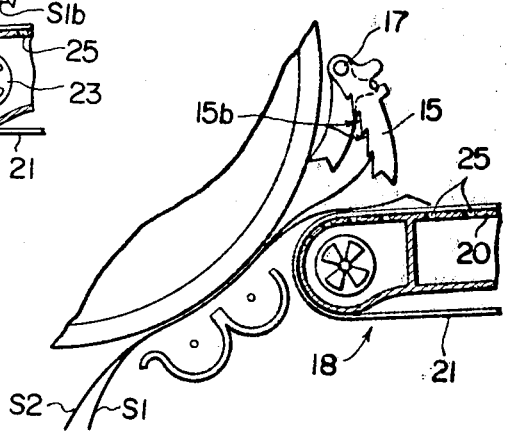
Figure 9C:
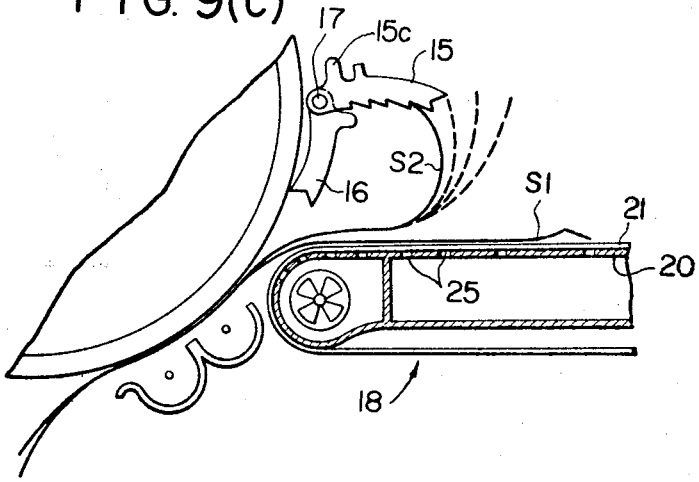

As shown in FIG. 9(*a*), when two image transfer sheets S, which are in close contact with each other, are transported continuously after image transfer; under the above-mentioned condition that the top sheet is positioned slightly ahead of the next sheet, the deformed portion S1b of the top image transfer sheet S1 is caught by the catching portion 15*a* of the sheet separation member 15 and then rotates the separation member 15.

In the separation member 15, there is formed a saw-tooth-shaped sheet catching portion 15*b*. A leading edge corner of the next image transfer sheet S2 comes into contact, for example, with the lowermost portion of the saw-tooth-shaped sheet catching portion 15*b* as shown in FIG. 9(*b*), while the top image transfer sheet S1 is attracted to the air-suction-type sheet transportation apparatus 18, so that the top image transfer sheet S1 is transported towards the image fixing apparatus by the sheet transportation belts 21.

Meanwhile the next image transfer sheet S2 rotates the separation member 15. With further movement of the image transfer sheet S2, the image transfer sheet S2 is detached from the separation member 15 as shown by the broken lines in FIG. 9(*c*) due to the firmness of the image transfer sheet S2 when the separation member 15 comes to a predetermined position. As a result, the image transfer sheet S2 is turned towards the air-suction-type sheet transportation apparatus 18 and is then attracted thereto, so that the image transfer sheet S2 is transported by the sheet transportation belts 21, following the top image transfer sheet S1.

Thus, when double sheet feeding happens to take place, those sheets can be attracted to the air-suction-type sheet transportation apparatus 18, so that there is minimal risk that the double-fed sheets are jammed at the sheet separation member 15 and moreover those double-fed sheets can be recovered with minimal difficulties.

Figure 10A:
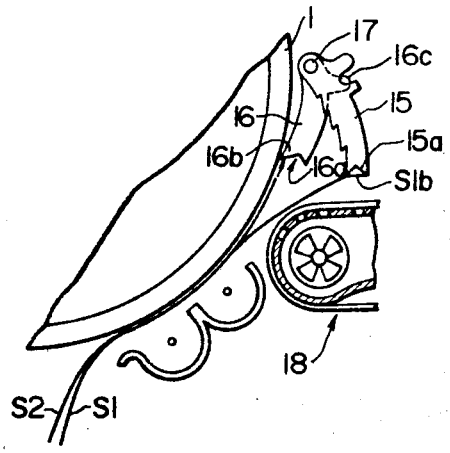
FIGS. 10(*a*) to 10(*c*) show the change of the transportation direction of one of the superimposed sheets of image transfer material, which is in direct contact with the surface of the photoconductor, after image transfer.
Figure 10B:
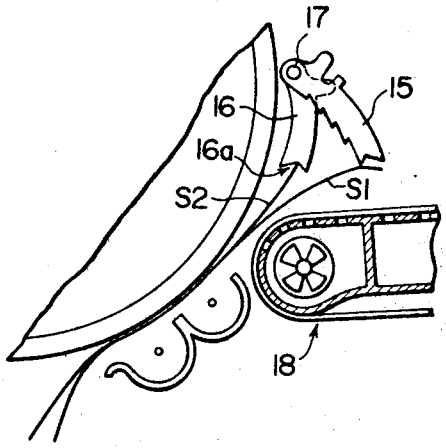
Figure 10C:
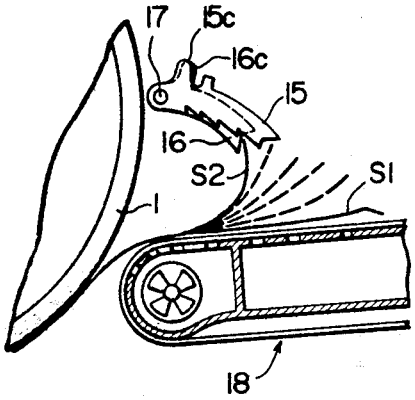

In the double feeding, it may occur that those double-fed sheets are separated from each other after image transfer as shown in FIG. 10(*a*) and the image transfer sheet S2 in direct contact with the surface of the photoconductor drum 1 is transported together with the photoconductor drum 1, remaining in close contact with the surface of the photoconductor drum 1. When this trouble takes place, the auxiliary separation member 16 can separate such a sheet from the photoconductor drum 1 as follows:

Referring to FIG. 10(*a*), the top image transfer sheet S1 is caught by the separation member 15 under the normal sheet separation procedure and is attracted to the air-suction-type sheet separation apparatus 18 and is then transported towards the image fixing section. Meanwhile, a leading edge corner portion of the next image transfer sheet S2 is separated from the surface of the photoconductor drum 1 by the pawl portion 16*b* of the auxiliary separation member 16 which is in light contact with the surface of the photoconductor drum 1. The leading edge corner portion of the image transfer sheet S2 then comes into contact with the V-shaped sheet catching portion 16*a* of the auxiliary separation member 16 and then rotates the auxiliary separation member 16. With further movement of the image transfer sheet S2, the image transfer sheet S2 is detached from the auxiliary separation member 16 as shown by the broken lines in FIG. 10(*c*) due to the firmness of the image transfer sheet S2 when the auxiliary separation member 16 comes to a predetermined position. As a result, the image transfer sheet S2 is turned towards the air-suction-type sheet transportation apparatus 18 and is then attracted thereto, so that the image transfer sheet S2 is transported by the sheet transportation belts 21, following the top image transfer sheet S1. Thus, the image transfer sheet S2 on the side of the photoconductor drum 1 can be attracted to the air-suction-type sheet transportation apparatus 18, following the top image transfer sheet S1, without directing the image transfer sheet S2 towards the cleaning apparatus 29 (refer to FIG. 1), so that there is minimal risk that the double-fed sheets are jammed at the sheet separation member 15 and moreover those double-fed sheets can be recovered with minimal difficulties. After the image transfer sheet S2 is detached from the auxiliary separation member 16, both the separation member 15 and the auxiliary separation member 16 are caused to return to their respective home positions because of the force applied thereto by their respective weight portions 15*c* and 16*c*.

Referring to FIG. 10(*a*), the weight 16*c* of the auxiliary separation member 16 determines the pressure which is applied against the surface of the photoconductor drum 1 by the pawl portion 16*b*.

As shown in FIG. 1, the separation member 15 is disposed away from the surface of the photoconductor drum 1 with a small gap G therebetween, whereby it is prevented that the separation member 15 scratches the surface of the photoconductor drum 1 by the frequent rotating operation of the separation member 15. Since the separation members 15 and 16 are caused to rotate by the advancing force of image transfer sheets and the firmness thereof, it is required that the separation members 15 and 16 be light in weight. Furthermore, since the auxiliary sheet separation member 16 is normally in contact with the surface of the photoconductor drum 1, it is preferable that the auxiliary sheet separation member 16 is made of a softer material than the material of the separation member 15.

As shown in FIG. 3, by forming the free end portion of the auxiliary sheet separation member 16 with an acute angle, which is less than the right angle by an angle $\theta$, only the acute angle portion of the sheet separation member 16 can be brought into contact with the surface of the photoconductor drum 1, so that the contact area of the sheet separation member 16 on the photoconductor drum 1 can be decreased and accordingly the risk that toner remaining on the photoconductor drum 1 is deposited on the image transfer sheet S, degrading the image formed on the image transfer sheet S, is minimized.

Figure 11:
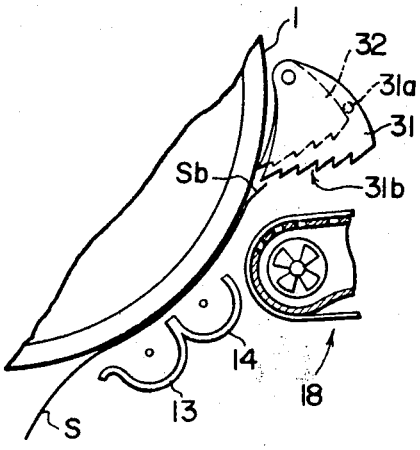
FIG. 11 is a diagrammatical view of another image transfer separation member and of another auxiliary separation member.

Referring to FIG. 11, there are shown a modified separation member 31 and a modified auxiliary sheet separation member 32 for use in the present invention. The separation member 31 is maintained at a position shown in FIG. 11 by a pin 31*a* secured to the separation member 31, which pin 31*a* is in contact with the back side of the auxiliary sheet separation member 32. The leading edge corner portion Sb of the image transfer sheet S is caught by one of a plurality of saw-tooth-shaped catching portions formed in the separation member 31. The sheet separating functions of the separation member 31 and the auxiliary sheet separation member 32 are the same as those of the separation member 15 and the auxiliary sheet separation member 16 so far explained.

Figure 12:
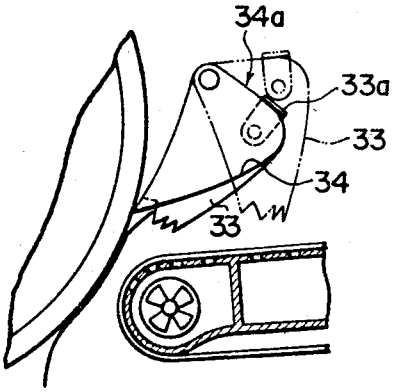
FIG. 12 is a diagrammatical view of a further image transfer separation member and of a further auxiliary separation member.
Figure 13:
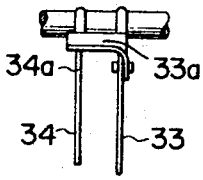
FIG. 13 shows the configuration of the image transfer separation member and the auxiliary separation member.

Referring to FIG. 12, there are shown a further modified separation member 33 and a further modified auxiliary sheet separation member 34. The separation member 33 is maintained at a position shown in FIG. 12 by a receiving member 33*a* fixed to the separation member 33 by caulking which receiving member 33*a* is in contact with a back side portion 34*a* of the auxiliary sheet separation member 34 as shown in FIG. 13.

Figure 14:
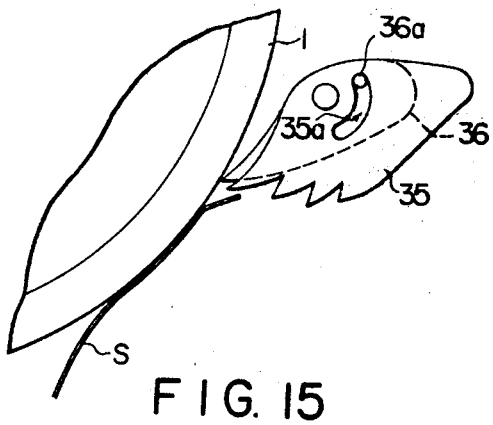
FIG. 14 is a diagrammatical view of a still further image transfer separation member and of a still further auxiliary separation member.

Referring to FIG. 14, there are shown a further example of a separation member and a further example of an auxiliary sheet separation member, which are respectively a separation member 35 and an an auxiliary sheet separation member 36. The separation member 35 is maintained at a position shown in FIG. 14 by a guide slot 35*a* and a pin 36*a*.

In the above explanation about the auxiliary sheet separation members, emphasis has been laid on the point that those auxiliary sheet separation members serve as auxiliary sheet separation means, which each of the pawl portions normally maintained in contact with the surface of the photoconductor drum 1, but those auxiliary sheet separation members also serve to maintain the previously mentioned gap G between each of the separation members and the surface of the photoconductor drum 1.

Figure 15:
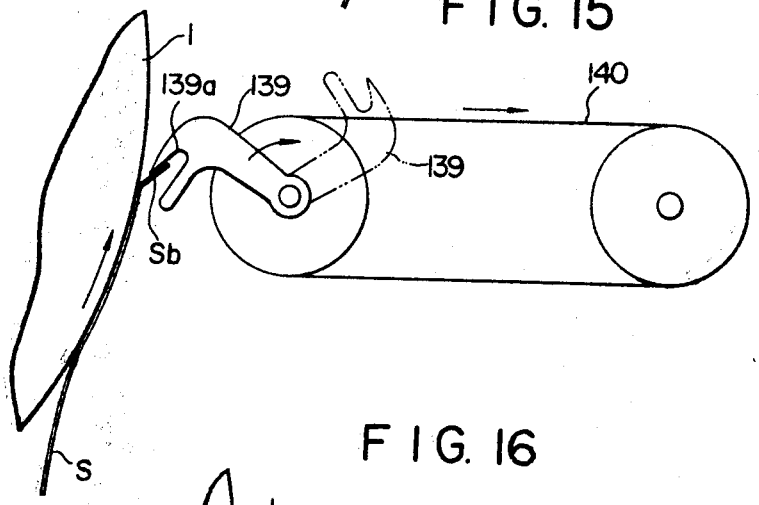
FIG. 15 is a diagrammatical view of an image transfer material separation apparatus according to the invention.

Referring to FIG. 15, there is diagrammatically shown an image transfer material separation apparatus of a type in which a separation member 139 makes one revolution according to the present invention. In this apparatus, the separation member 139 is normally maintained at a position shown by the solid line in FIG. 15. When the separation member 139 is at that position, the deformed portion Sb of the image transfer material S is caught by a catching portion 139*a* of the sheet separation member 139. When the deformed portion Sb is caught by the catching portion 139*a*, the deformed portion Sb rotates the separation member 139 clockwise. In the meanwhile, the transportation direction of the image transfer sheet S is changed. Thereafter, the image transfer sheet S is attracted to sheet transportation belts 140 through an air-suction apparatus disposed inside the sheet transportation belts 140, so that the image transfer sheet S is transported by the sheet transportation belts 140. When the separation member 139 comes to a position shown by the imaginary line in FIG. 15, it is rotated downwards by the weight thereof and is then caused to return to its original position shown by the solid line under application of driving force thereto. This can be done by use of a one-way clutch, such as a conventional spring clutch.

Figure 16:
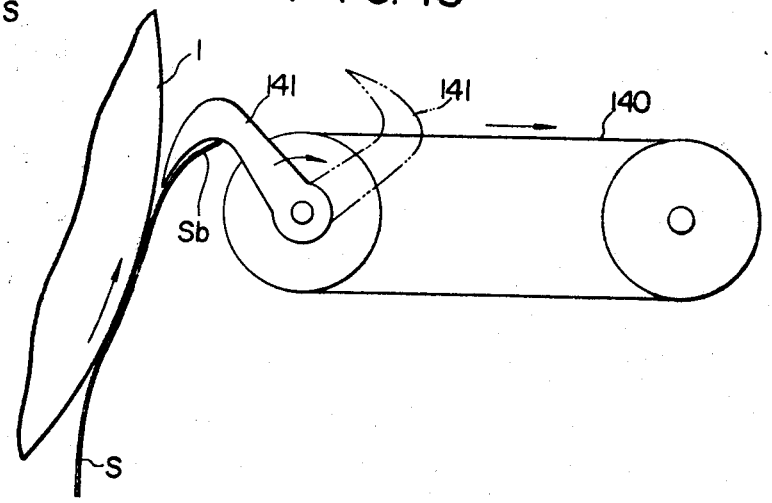
FIG. 16 is a diagrammtical view of another image transfer material separation apparatus according to the invention.

Referring to FIG. 16, there is diagrammatically shown an image transfer material separation apparatus employing a sickel-shaped separation member 141. In this apparatus, the deformed portion of the image transfer sheet S pushes the separation member 141 and rotates the same. During the rotation of the separation member 141, the transportation direction of the image transfer sheet S is changed.

Figure 17:
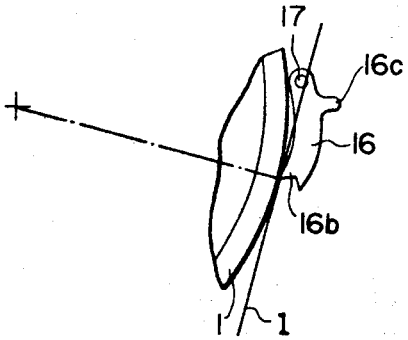
FIGS. 17 and 18 show the auxiliary separation member in explanation of the difference of its function depending upon the position of the fulcrum of the auxiliary separation member.
Figure 18:
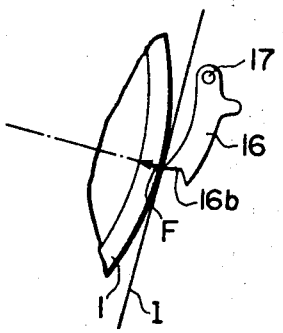

As shown in FIG. 17, the shaft 17 on which the auxiliary sheet separation member 16 and the separation member 15 are pivotally mounted, that is, the supporting point of the two separation members 15 and 16, is positioned on the side of the photoconductor drum 1 with respect to the tangent l at the point where the pawl portion 16*b* of the auxiliary separation member 16 is in contact with the surface of the photoconductor drum 1. In contrast to this, if the shaft 17 is positioned on the right side of the tangent, as shown in FIG. 18, when the pawl portion 16*b* is pushed by the leading edge of the image transfer sheet S, a force F directed towards the center of the photoconductor drum 1 is generated at the contact point where the pawl portion 16*b* comes into contact with the surface of the photoconductor drum 1, so that there is the risk that the photoconductor drum 1 may be scratched by the pawl portion 16*b*.

Therefore, when the shaft 17, namely the supporting point, is on the left side with respect to the tangent l as shown in FIG. 17, the force F is not generated. Further, in this case, when the leading edge of the image transfer sheet S pushes the pawl portion 16*b*, the moment which rotates the auxiliary separation member 16 counterclockwise is generated. As a result, the transportation direction of the image transfer sheet S can be securely changed by the separation member 15 and by the auxiliary sheet separation member 16. Normally, the auxiliary sheet separation member 16 is urged to rotate clockwise by the weight portion 16*c* thereof and is positioned as shown in FIG. 17.

In the embodiments described above, the leading edge corner of the image transfer sheet S is lifted from the surface of the photoconductor drum 1 and deformed so as to be maintained away from the surface of the photoconductor drum 1 in order to separate the image transfer sheet S from the photoconductor drum 1.

Figure 19:
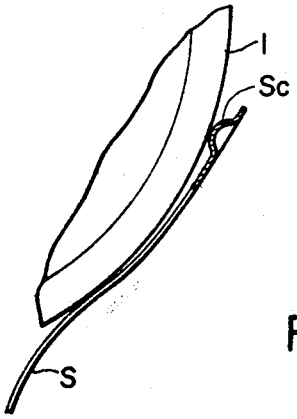
FIG. 19 is a schematic sectional view of another example of a deformed portion of the image transfer material.
Figure 20:
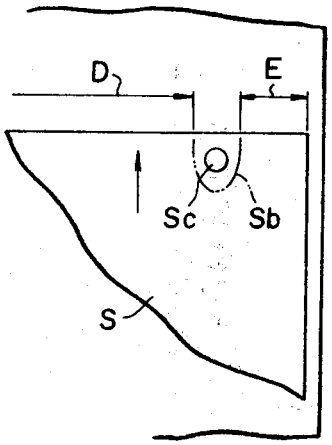
FIG. 20 is a schematic view of the image transfer material in explanation of the position of the deformed portion thereof.

The same object can be attained by deforming the image transfer sheet S as follows:

As shown in FIG. 19, a circular portion Sc which is projected towards the photoconductor drum 1 is formed in a leading edge portion of the image transfer sheet S. The circular projected portion Sc is positioned in a leading edge corner portion of the image transfer sheet S and an area in the image transfer sheet S near the circular projected portion Sc is not in contact with the surface of the photoconductor drum 1, while the leading edge portion in an area D and an area E of the image transfer sheet S is in close contact with the surface of the photoconductor drum 1. Thus, the circular projected portion Sc constitutes a deformed portion Sb which corresponds to the previously mentioned deformed portion Sb. Such deformation does not extend to the areas D and E in the image transfer sheet S. When the projected portion Sc is positioned nearer to the right side end of the image transfer sheet S in FIG. 20, the corner end portion of the image transfer sheet S is separated from the surface of the photoconductor drum 1. The thus deformed portion Sb can be caught by the sheet separation member 15 for separation of the image transfer sheet S. In this case, by forming a plurality of deformed portions Sb in the image transfer sheet S in the transverse direction thereof and disposing a plurality of separation members corresponding to the deformed portions Sb in terms of each position thereof, separation of the image transfer sheet S from the photoconductor drum 1 can be performed.

In the case of such a deformation method, the leading edge portion other than the deformed portion Sb of the image transfer sheet S is not deformed and therefore the image transfer sheet S can be smoothly inserted between a pair of image fixing rollers and the risk of forming wrinkles in the image transfer sheet S can be significantly reduced.

Figure 21:
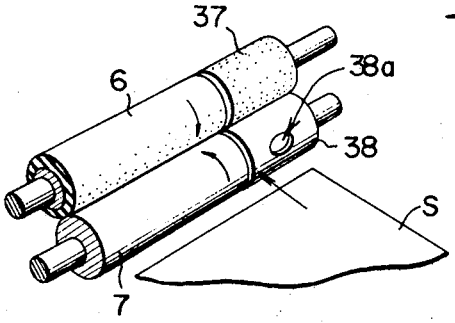
FIG. 21 is a perspective view of an example of a device for forming the deformed portion in the image transfer material.

Another type of transfer sheet deformation apparatus for forming a deformed portion in the image transfer sheet S is shown in FIG. 21. This deformation apparatus comprises an elastic roller 37 and a roller 38 with a circular hole 38*a* with a predetermined depth. The image transfer sheet S is caused to pass between the two rollers 37 and 38, whereby a circular projected portion Sc is formed at a position corresponding to the circular hole 38*a* of the roller 38.

Further examples of transfer sheet deformation apparatus will now be explained.

Figure 22:
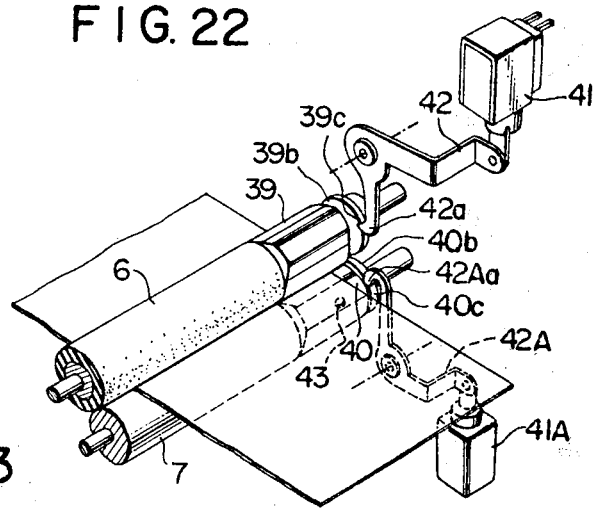
FIG. 22 is a perspective view of another example of a device for forming a deformed portion in the image transfer material.

Referring to FIG. 22, there is shown an example of transfer sheet deformation apparatus. In this apparatus, there are disposed registration rollers 6 and 7 for transporting the image transfer sheet S towards the photoconductor drum 1 by passing the image transfer sheet S therebetween. The registration roller 6 and the registration roller 7 respectively include an elastic roller 39 and a rotary roller 40 at their respective end portions. The elastic roller 39 is made of an elastic material, for instance, soft rubber. The cross section of the the elastic roller 39 is in the shape of a cam including a circular portion 39A with the same diameter as that of the registration roller 6 and a projected portion 39B greater in diameter by a distance α than the diameter of the circular portion 39A. The elastic roller 39 performs the function of the so-called sleeve of a spring clutch mechanism. A stop projection 42*a* of a stop lever 42 to which a solenoid 42 is connected engages a step portion 39*c* formed in a flange portion 39*b* of the elastic roller 39.

Figure 23:
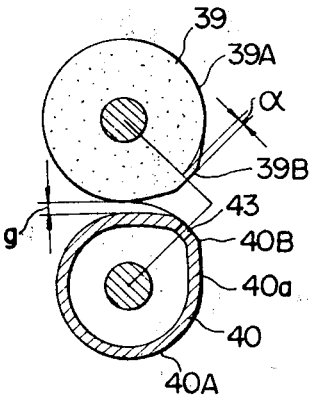
FIG. 23 is a schematic sectional view of an elastic roller and a counterpart roller shown in FIG. 22, which schematic sectional view particularly shows the configuration of the two rollers.

The cross section of the rotary roller 40 is in the shape of a cam similar to that of the elastic roller 39 as shown in FIG. 23, including a small diameter portion 40A which is smaller than the diameter of the registration roller 7, a large diameter portion 40B which is the same as the diameter of the registration roller 7, and an inclined portion 40*a* which smoothly connects the two portions 40A and 40B. In the large diameter portion 40B, a small hole 43 is formed.

Normally, the elastic roller 39 and the rotary roller 40 are stopped at the respective positions with a gap which allows the image transfer sheet S to pass therethrough, as shown in FIG. 23. As will be described in more detail, the two rollers 39 and 40 begin to rotate in accordance with an image-transfer-sheet-passing-signal, so that the image transfer sheet S is held between the two rollers 39 and 40 and the projected portion 39B of the elastic roller 39 is brought into pressure contact with the large diameter portion 40B of the rotary roller 40. As a result, part of the image transfer sheet S is forced into the small hole 43.

Figure 24:
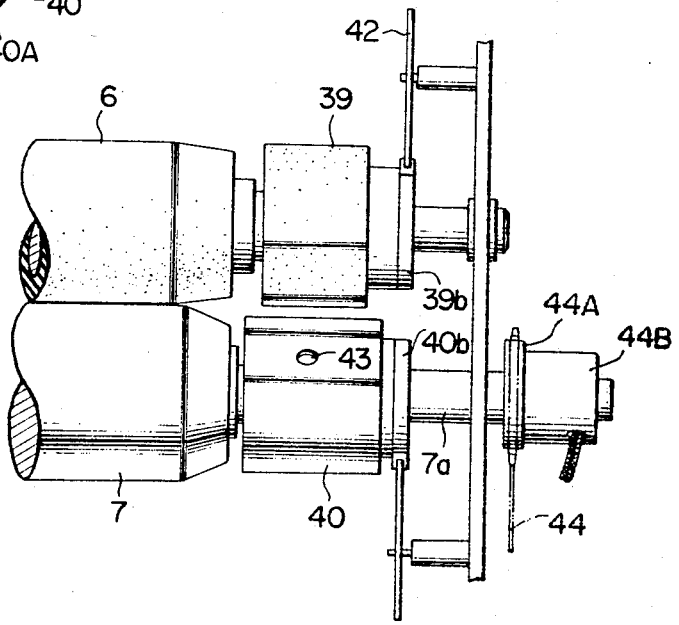
FIG. 24 is a schematic side view of the elastic roller and the counterpart roller shown in FIG. 22.

Referring to FIG. 22 and FIG. 24, the elastic roller 39 and the rotary roller 40 each perform the function of the so-called sleeve of a one-rotation clutch mechanism. Stop projections 42*a* and 42A*a* of stop levers 42 and 42A to which solenoids 41 and 41A are respectively connected engage respectively step portions 39*c* and 40*c* formed respectively in flanges 39*b* and 40*b* of the two rollers 39 and 40.

The driving system for the registration rollers 6 and 7 comprises a sprocket 44A which engages a chain 44 for input power source and a clutch 44B for stopping the rotation of a roller shaft 7*a* in accordance with a sheet transportation signal. The sprocket 44A and the clutch 44B are the same in size. The registration rollers 6 and 7 are disposed in pressure contact with each other and are driven in rotation in the directions of the respective arrows.

Figure 25:
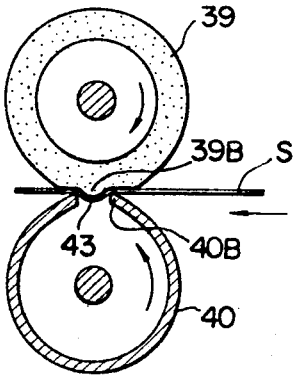
FIGS. 25 to 27 are schematic views of an image transfer sheet in explanation of the formation of a projected portion in a leading edge corner portion of the image transfer sheet.
Figure 26:
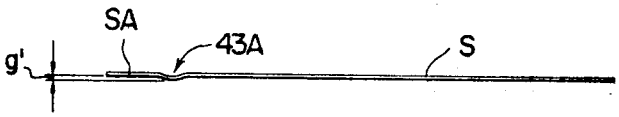

Referring to FIG. 22, the image transfer sheet S fed from the sheet feeding cassette 2 (refer to FIG. 1) is inserted into the contact area between the registration rollers 6 and 7 and is caused to stand by under this condition. In accordance with the generation of the sheet transportation signal, the registration rollers 6 and 7 begin to be rotated in the directions shown by the respective arrows by the driving system shown in FIG. 24. At the same time, the solenoid 41 (refer to FIG. 22) is energized. Upon the solenoid 41 being energized, the stop levers 42 and 42A are rotated, whereby the stop projections 42*a* and 42A*a* release the step portions 39*c* and 40*c* of the flanges 39*b* and 40*b*. By the functioning of the one-rotation clutch, the elastic roller 39 and the rotary roller 40 begin to be rotated respectively in the same directions as the rotating directions of the registration roller 6 and the registration roller 7. The image transfer sheet S is held between the registration rollers 6 and 7 and transported. In the course of this transportation, the projected portion 39B of the elastic roller 39 is brought into pressure contact with the large diameter portion 40B of the rotary roller 40 and part of the image transfer sheet S is forced into a hole 43 as shown in FIG. 25, so that the image transfer sheet S is deformed so as to have a projected portion 43A, corresponding to the hole 43, near the leading edge portion thereof as shown in FIG. 26. With further rotation of the elastic roller 39 and the rotary roller 40, the stop projections 42*a* and 42A*a* of the stop levers 42 and 42A are respectively brought into sliding contact with the peripheral surface of the flange 39*b* and with the peripheral surface of the flange 40*b* and thereafter respectively engage the step portions 39*c* and 40*c*. As a result, the elastic roller 39 and the rotary roller 40 are stopped at that position. In the meanwhile, the registration rollers 6 and 7 are continuously rotated. However, since there is formed a gap g between the elastic roller 39 and the rotary roller 40, the image transfer sheet S is transported towards the photoconductor drum 1 without being hindered.

FIG. 26 shows the cross section of the image transfer sheet S which has passed through the elastic roller 39 and the rotary roller 40. Due to the presence of the projected portion 43A, it is preferable that the gap g′ between the surface of the photoconductor drum 1 and the image transfer sheet S is in the range of about 0.1 mm to about 1.0 mm.

Figure 27:
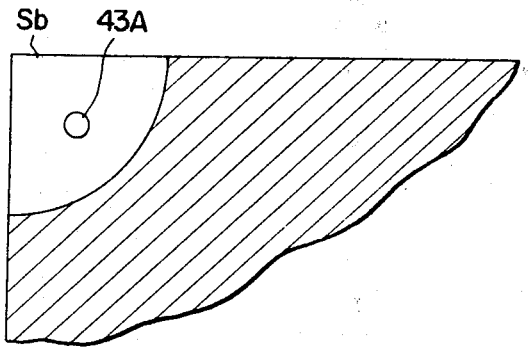

As shown in FIG. 27, by forming the projected portion 43A in the leading edge corner of the image transfer sheet S, the lifted portion Sb is formed. In a dry type development system, when an image to be transferred to the lifted portion Sb is present on the surface of the photoconductor drum 1, that image can be transferred to the image transfer sheet S so long as the above-mentioned gap g′ is small enough.

It is not always necessary that the elastic roller 39 and the rotary roller 40 be positioned on one shaft end side of each of the registration rollers 6 and 7, but the following elastic roller and rotary roller, which are positioned within the traverse range of the image transfer sheet S with respect to the moving direction of the image transfer sheet S, can be used, with elastic roller includes an outer peripheral surface portion in contact with the outer surface of the image transfer sheet S, and a projected portion formed in part of the outer peripheral surface portion of the elastic roller; and which rotary roller includes a small diameter portion with a space with respect to the image transfer sheet S, and a large diameter portion formed in part of the small diameter portion, which large diameter portion comes into contact with the surface of the image transfer sheet S and serves to hold the image transfer sheet S in association with the outer peripheral surface of the elastic roller and a concave portion formed in the large diameter portion, into which concave portion the projected portion can be inserted.

In the above-described embodiments, a projected portion is formed only in a leading edge corner of the image transfer sheet S. Alternatively, a plurality of such projected portions can be formed along the leading edge of the image transfer sheet S. In this case, as a matter of course, the same number of projected-portion-formation apparatuses and sheet separation members as the number of projected portions is required. When a dry type development system is employed, images can be transferred to the above-mentioned projected portions and thereabout in the image transfer sheet S.

Furthermore, since the projected portion 43A is formed in the image transfer sheet S after the leading edge portion SA of the image transfer sheet S has been tightly held between the elastic roller 23 and the rotary roller 24, the leading edge portion SA is not deformed and furthermore, formation of wrinkles in the image transfer sheet S during image fixing can be prevented.

In the above-mentioned embodiments, the projected portion is formed in the leading edge corner of the image transfer sheet S as the deformed portion, without piercing the image transfer sheet S. However, the present invention is not limited to the formation of such projected portion, but small holes which are formed so as to pierce the image formation sheet S can be employed in the present invention.

Figure 28:
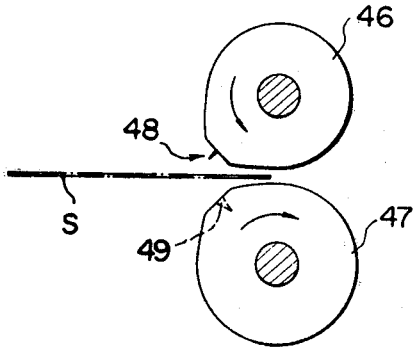
FIG. 28 is a side view of the main portion of another embodiment of an image transfer material separation apparatus according to the invention.

Referring to FIG. 28, a roller 46 and a roller 47 are each attached to the end portions of the registration rollers in the same manner as the attachment of the elastic roller 39 and the rotary roller 40 to the registration rollers (refer to FIGS. 23 and 24). The construction of the surface portion of each of the rollers 46 and 47 and the configuration of the two rollers 46 and 47 are the same as those of the previously described rollers 39 and 40.

The roller 47 is made of a comparatively hard member to which a stylus member 48 having a sufficient length for piercing the image transfer sheet S is secured. The counterpart roller 47 is made of a comparatively soft material, for instance, sponge rubber, or a comparatively hard member which an aperture 49 for accepting the stylus member 48 therein.

Figure 29:
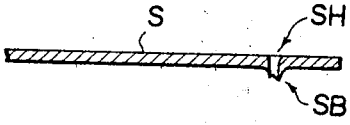
FIG. 29 is an enlarged sectional view of an image transfer sheet in which a projected portion is formed by the apparatus shown in FIG. 28.

Referring to FIG. 28, a pair of registration rollers (not shown) are in a stand-by state and the image transfer sheet S is inserted between the rollers 46 and 47. As the registration rollers are rotated, the roller 46 and 47 are also rotated, so that a piercing aperture SH is formed in a predetermined position in the leading edge postion of the image transfer sheet S by the stylus member 48 as shown in FIG. 29. When the piercing hole SH is formed, a burr SB is formed in the hole Sh on the surface of the image transfer sheet S which comes into contact with the surface of the photoconductor drum 1. In this embodiment, the above-mentioned buss SB is utilized as a projected portion in the leading edge corner of the image transfer sheet S for lifting the sheet S from the surface of the photoconductor drum 1 in the same manner as in the case of the projected portion 43A in the previously described embodiments. In fact, the burr SB performs the same function as that of the projected portion 43A for separating the image transfer sheet S from the surface of the photoconductor drum 1. Furthermore, since the pierced hole SH is so small that it does not cause any problem for practical image transfer.

Figure 30A:
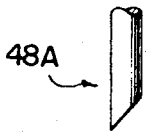
FIGS. 30(*a*) and 30(*b*) show a front view of an example of a stylus member and a perspective view of the same.
Figure 30B:
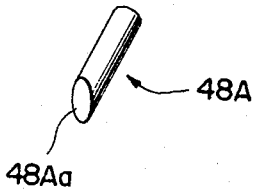
Figure 31:
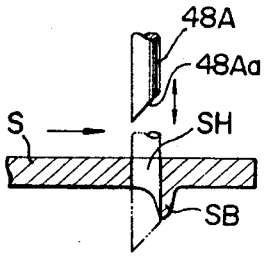
FIG. 31 is an enlarged sectional view of an image transfer sheet in which a projected portion is formed by the stylus member shown in FIG. 30.

The sharp end portion of the stylus member 48 can be formed in the shape of circular cone, but it can be formed in the shape of slantingly cut cylinder as shown in FIG. 30. When the pierced hole SH is formed by use of the stylus member 48A, with the cut surface 48A*a* directed towards the leading edge of the image transfer sheet S as shown in FIG. 31, the burr SB is formed on the leading edge side of the image transfer sheet S. Therefore, when the image transfer sheet S comes into contact with the surface of the photoconductor drum 1, the leading edge portion of the image transfer sheet S is separated from the surface of the photoconductor drum 1, but the remaining portion of the image transfer sheet S behind the pierced hole SH can be brought into close contact with the surface of the photoconductor drum 1. Therefore, a portion to which images cannot be transferred can be minimized.

Figure 32:
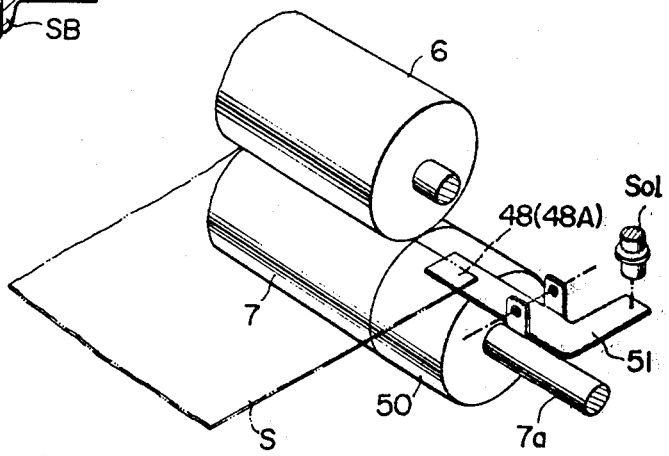
FIG. 32 is a perspective view of the main portion of a further embodiment of an image transfer material separation apparatus according to the present invention.
Figure 33:
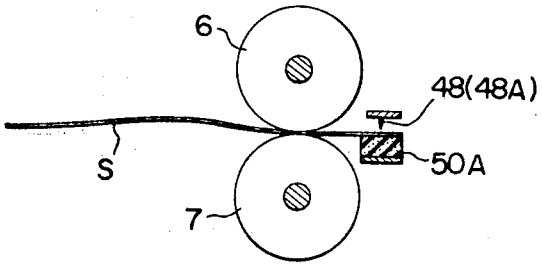
FIG. 33 is a side view of the main portion of a still further embodiment of an image transfer material separation apparatus according to the present invention.

As the means for forming such pierced hole in a predetermined position near the leading edge of the image, the apparatuses shown in FIG. 32 and FIG. 33 can be employed.

Referring to FIG. 32, the apparatus for forming the pierced hole in the image transfer sheet S is shown. In this apparatus, one end portion of the lower registration roller 7 is made of an elastic member 50, and the upper registration roller 6 is made shorter than the lower registration roller 7. When the image transfer sheet S inserted between the two rollers 6 and 7 is caused to stand by in that position, a pierced hole is formed in the image transfer sheet S. The means for making such pierced hole in the image transfer sheet S comprises a support lever 51 which supports the previously mentioned stylus member 48(48A) and is swingable, and a solenoid Sol (only the operation lever is shown in FIG. 32) which swings the stylus member 48(48A) supported by the support lever 51 in such a direction as to pierce the image transfer sheet S which is caused to stand by. The solenoid Sol is continuously energized until the image transfer sheet S comes into contact with the image transfer sheet S and is then fed therefrom. Thus, the pierced hole is formed by swinging the lever 51.

Referring to FIG. 33, there is shown a case where a pierced hole is made in the image transfer sheet S which is being transported by the registration rollers 6 and 7 or which is temporarily stopped. In the figure, reference numeral 50A represents an elastic member. The stylus member 48(48A) is moved towards the image transfer sheet S to make the pierced hole with an appropriate timing.

The projected portions formed by the apparatuses shown in FIG. 32 and FIG. 33 consist of the same burr as that mentioned previously and perform the same function as that of the previously mentioned burr SB.

Figure 34:
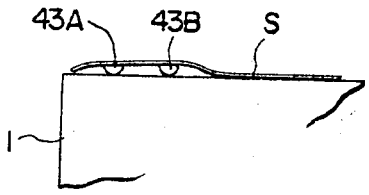
FIG. 34 is an enlarged sectional view of another image transfer sheet with a projected portion formed therein.

In the above, one projected portion is formed in a predetermined position in the leading edge portion of the image transfer sheet S, including the above-mentioned leading corner edge portion. However, when a pair of projected portions 43A and 43B, positioned closely to each other, are formed as shown in FIG. 34, the image transfer sheet S can be more securely separated from the surface of the photoconductor drum 1. In this case, it is preferable that a sheet catching and separation member is disposed between the pair of projected portions 43A and 43B.

In the so far explained embodiments of an image transfer material separation apparatus according to the present invention, the air-suction-type sheet transportation apparatus 18 is employed as image transfer sheet catching and transportation apparatus after the transportation direction of the image transfer sheet S has been changed. As the image transfer sheet catching and transportation apparatus, sheet transportation belts provided with a charger for electrostatically attracting the image transfer sheet S to the sheet transportation belts can also employed.

The requirement for the image transfer sheet catching and transportation apparatus is that the transportation direction of the image transfer sheet S can be set in a predetermined direction after the transportation direction of the image transfer sheet S has been changed and can be transported towards the image fixing apparatus.

As the apparatus for deforming a leading edge portion of the image transfer sheet S, an apparatus capable of deforming the desired portion in the transverse area of the image transfer sheet S with respect to the transportation direction of the image transfer sheets, without lifting only a leading edge corner portion of the image transfer sheet S and deforming the same.

In short, the requirement for the apparatus for deforming a leading edge portion of the image transfer sheet S is that a leading edge portion of the image transfer sheet S be lifted above the surface of the photoconductor drum 1 in such a manner that the deformed portion can be caught by a sheet separation member.

In the image transfer material separation apparatus for an electrophotographic copying machine according to the present invention, a lifted and deformed portion is formed in a leading edge portion of image transfer material prior to image transfer process and the deformed portion is then caught by an image transfer material separation member. The image transfer material separation member is rotated by the advancing force of the image transfer material, whereby the transportation direction of the image transfer material can be accurately changed without any fluctuation. The image transfer material whose transportation direction has been changed is securely caught by an image transfer material catching and transportation apparatus. Therefore, separation of the image transfer material from the surface of the photoconductor drum can be performed securely and accurately, without the image on the image transfer material being scratched by a separation pawl, unlike the conventional image transfer material separation apparatus.

Furthermore, separation of the leading edge portion of the image transfer material from the surface of the photoconductor drum is not affected by the voltage applied to a sheet separation charger and other devices in contrast to the conventional apparatus. Moreover, in the present invention, it is not always necessary to bring the image transfer material separation member into contact with the surface of the photoconductor drum. Therefore, the risk that the surface of the photoconductor drum is scratched by the separation member is minimized.

What is claimed is:

1. An apparatus for separating image transfer material brought into close contact with a photoconductor having an image formed thereon, comprising:

a leading-edge-portion-lifting-and-deforming means for deforming a leading edge portion of said image transfer material as it is being directed to said photoconductor to lift the same from said photoconductor;

means including an image transfer material separation member having a base portion thereof swingably supported and the free end portion thereof disposed in close proximity to the surface of said photoconductor, said member including a catching portion for catching the deformed portion of the image transfer material so that after the deformed leading edge portion of said image transfer material comes into contact with said catching portion, the free end portion of said image transfer material separation member is caused to rotate in such a direction as to move away from the surface of said photoconductor by the advancing force of said image transfer material to gradually separate said image transfer material from the surface of said photoconductor and guide the leading edge of said image transfer material in such a direction so as to be separated from the surface of said photoconductor;

said image transfer material separation member having a gap formation means for continually maintaining a gap between the free end of said image transfer material separation member and the surface of said photoconductor, said gap formation means including an auxiliary sheet separation device having a base portion swingably supported independently of said image transfer material separation member and a free end portion having a pawl means for catching a leading edge of any image transfer material not caught by said image transfer material separation member, said pawl means adapted to ride in contact along a rim portion of said photoconductor, and a portion of said image transfer material separation member engaging said auxiliary device to be held thereby in a manner continually holding said member in spaced relation from said photoconductor, and an image transfer material catching and transportion means disposed near the free end of said image transfer material separation member for catching and transporting the image transfer material after its transportion direction has been changed.

2. An image transfer separation apparatus as claimed in claim 1, wherein said leading-edge-portion-lifting-and-deforming means includes an apparatus for deforming only a leading edge corner portion of said image transfer material.

3. An image transfer material separation apparatus as claimed in claim 2, wherein said leading-edge-portion-lifting-and-deforming means is disposed on one side of a transportation path for said image transfer material and comprises a bent-blade roller having a blade on the peripheral surface of said bent-blade roller, for bending said image transfer material, and an elastic roller into which said bent-blade can be pressed through said image transfer material in order to bend a leading edge corner of said image transfer material in association with said bent-blade roller.

4. An image transfer material separation apparatus as claimed in claim 1, wherein said leading-edge-portion-lifting-and-deforming means comprises a roller made of a hard material having a circular hole on the peripheral surface thereof, and an elastic roller for forcing part of said image transfer mateial into said circular hole in order to deform a leading edge corner of said image transfer material in association with said bent-blade roller.

5. An image transfer material separation apparatus as claimed in claim 1, wherein said leading-edge-portion-lifting-and-deforming means comprises:

an elastic roller having an outer peripheral surface portion which comes into contact with the transportation surface of said image transfer material and a projected portion formed in said outer peripheral surface portion of said elastic roller; and a rotary roller having a small diameter portion which forms a gap with respect to said transportation surface of said image transfer material, a large diameter portion which is projected so as to come into contact with said transportation surface of said image transfer material and hold said image transfer material in association with said outer peripheral surface portion of said elastic roller, and a concave portion formed in said large diameter portion, which concave portion can receive said projected portion of said elastic roller, a projected portion being formed in said image transfer material by passing said image transfer material between said elastic roller and said rotary roller.

6. An image transfer material separation apparatus as claimed in claim 1, wherein said leading-edge-portion-lifting-and-deforming means is disposed on the side opposite to the surface of said photoconductor with which said image transfer material comes into contact and comprises a stylus member for forming a pierced hole in a predetermined position of a leading edge portion of said image transfer material, and a driving means for driving said stylus member in such a direction as to form said hole in said image transfer material, the burr of the thus formed hole constituting a projected portion of said image transfer material.

7. An image transfer material separation apparatus as claimed in claim 6, wherein said stylus member has an inclined cut-off end.

8. An image transfer material separation apparatus as claimed in claim 7, wherein said cut-off side of the end of said stylus member is directed towards the downstream side of the transportation direction of said image transfer material.

9. An image transfer material separation apparatus as claimed in claim 1, wherein said image transfer material separation member has a V-shaped sheet catching portion at the free end thereof for catching a leading edge portion of said image transfer material, said V-shaped sheet catching portion directed in the advancing direction of said image transfer material.

10. An image transfer material separation apparatus as claimed in claim 1, wherein said pawl means includes a portion inclined with respect to the axial direction of the surface of said photoconductor in order to minimize the contact area between said auxiliary sheet separation device and said photoconductor.

11. An image transfer material separation apparatus as claimed in claim 1, wherein said auxiliary sheet separation device includes a V-shaped sheet catching portion at the free end thereof for catching a leading edge portion of said image transfer material, said free end directed in the advancing direction of said image transfer material.

12. An image transfer material separation apparatus as claimed in claim 1, wherein said auxiliary sheet separation device is swingably supported on the same shaft as that of said image transfer material separation member in such a manner that the free end of said auxiliary sheet separation device can be moved away from the surface of said photoconductor.

13. An image transfer material separation apparatus as claimed in claim 1, wherein said auxiliary sheet separation device has a weight portion for bringing said pawl means thereof into contact with the surface of said photoconductor by swingable movement of said auxiliary sheet separation device under the weight thereof about the swinging center thereof.

14. An image transfer material separation apparatus as claimed in claim 1, wherein said auxiliary sheet separation device is disposed in such a manner that the swinging center of said auxiliary sheet separation device is positioned on the side of said photoconductor with respect to the tangent at the contact point where the top portion of said auxiliary sheet separation device and the surface of said photoconductor comes into contact with each other.

15. An image transfer material separation apparatus as claimed in claim 1, wherein said auxiliary sheet separation device has a plurality of saw-tooth-shaped sheet catching portions disposed substantially along the path through which said image transfer material separated from said photoconductor is transported.

16. An image transfer material separation apparatus as claimed in claim 1, wherein said pawl means of said auxiliary sheet separation device is brought into contact with the surface of said photoconductor by said image transfer material separation member which is urged to swing.

17. An image transfer material separation apparatus as claimed in claim 1, wherein said pawl means of said auxiliary sheet separation device is in contact with the surface of said photoconductor at a position downstream of the free end of said image transfer material separation member in terms of the movement direction of said photoconductor.

18. An image transfer material separation apparatus as claimed in claim 1, wherein said image transfer material separation member has a saw-tooth-shaped sheet catching portion at a middle portion thereof directed to the surface of said photoconductor for catching the leading edge of said image transfer material.

19. An image transfer material separation apparatus as claimed in claim 1, wherein said image transfer material separation member is urged to swing about the swinging center thereof by a weight portion thereof in such a manner as to bring the free end of said image transfer material separation member near the surface of said photoconductor.

20. An image transfer material separation apparatus as claimed in claim 1, wherein said image transfer material separation member is provided with a saw-tooth-shaped sheet catching portion disposed substantially along the path through which said image transfer material separated from said photoconductor is transported.

21. An image transfer material separation apparatus as claimed in claim 1, wherein said image transfer material catching and transportation means comprises endless belts and a negative-pressure tank provided with a plurality of air-suction holes.

22. An image transfer material separation apparatus as claimed in claim 21, wherein said endless belts are trained over a driving belt roller and said negative-pressure tank.

23. An image transfer material separation apparatus as claimed in claim 22, wherein a low-friction member is applied to each portion of each negative-pressure tank with which said endless belts are in contact and a low-friction member is applied to a portion of each of said endless belt with which said low-friction member of said negative-pressure tank is in contact.

24. An image transfer material separation apparatus as claimed in claim 22, wherein said endless belts are trained over groove portions of said negative-pressure tank and the image transfer material transportation surface of said endless belts and the image transfer material guiding surface of said negative-pressure tank are substantially in the same plane.

25. An image transfer material separation apparatus as claimed in claim 22, wherein a portion of said negative-pressure tank, located close to said photoconductor, over which portion said endless belts are trained, is semi-circular in cross section and is provided with air-suction holes.

26. An image transfer material separation apparatus as claimed in claim 21, wherein said negative-pressure tank is divided into two chambers, one chamber disposed closer to said photoconductor than the other.

27. An image transfer material separation apparatus as claimed in claim 26, wherein said chamber located closer to said photoconductor has such a negative-pressure distribution as being higher in negative pressure on the side of said image transfer material separation member than in the other portion of said chamber.

28. An image transfer material separation apparatus as claimed in claim 1, wherein said image transfer material separation member is disposed so as to be rotatable about a base portion thereof and when said image transfer material separation member catches a leading edge portion of said image transfer material and is rotated by said leading edge portion, said image transfer material separation member makes one revolution and returns to the original position thereof where the free end of said image transfer material separation member is positioned in proximity to the surface of said photoconductor.

* * * * *